United States Patent [19]

Jung

[11] 4,365,905

[45] Dec. 28, 1982

[54] CLAMPING DEVICE FOR FORM FEED MECHANISMS

[75] Inventor: Werner Jung, Morton Grove, Ill.

[73] Assignee: Teletype Corporation, Skokie, Ill.

[21] Appl. No.: 180,212

[22] Filed: Aug. 21, 1980

[51] Int. Cl.[3] ..... B41J 11/32; A44B 21/00

[52] U.S. Cl. ..... 400/616.2; 24/257

[58] Field of Search ..... 400/616.1, 616.2, 616.3; 24/255 R, 256, 257 R, 259 R; 411/516, 517, 522, 521, 352, 353; 339/326, 251, 252 S, 267; 403/240, 315, 316, 318

[56] References Cited

U.S. PATENT DOCUMENTS

| | | | |
|---|---|---|---|
| 2,025,848 | 12/1935 | Collis | 24/256 |
| 2,125,768 | 8/1938 | Christensen et al. | 24/259 R |
| 3,283,875 | 11/1966 | Davies | 197/133 |
| 3,297,916 | 1/1967 | Wright | 411/522 X |
| 3,608,801 | 9/1971 | Nystrand | 226/74 |
| 3,688,959 | 9/1972 | Staneck et al. | 226/75 |
| 4,113,397 | 9/1978 | Snyder | 411/521 X |
| 4,129,239 | 12/1978 | Hubbard | 226/75 |
| 4,130,230 | 12/1978 | Seitz | 226/75 |

FOREIGN PATENT DOCUMENTS

| | | | |
|---|---|---|---|
| 2615788 | 10/1976 | Fed. Rep. of Germany | 400/616.1 |

*Primary Examiner*—Richard J. Apley
*Assistant Examiner*—David J. Isabella
*Attorney, Agent, or Firm*—A. A. Tirva; J. C. Albrecht

[57] ABSTRACT

A printer tractor position clamp has two substantially parallel arms joined by a member having shape and size to engage a guide shaft and to secure a printer tractor to the shaft. Movement of the two arms towards each other releases the clamp from the guide shaft to permit lateral movement of the tractor along the shaft.

2 Claims, 5 Drawing Figures

CLAMPING DEVICE FOR FORM FEED MECHANISMS

DESCRIPTION

1. Technical Field

This invention relates to form feed mechanisms wherein pin feed devices feed a record medium having perforations along its edges, and more particularly, the invention relates to clamping devices for keeping form feed mechanisms in a particular position.

2. Background Art

Form feed mechanisms, also known as tractors, are well known in the art. Generally, such tractors include an endless belt trained in a loop over sprocket wheels which are driven by a drive shaft of a printer and are supported by a guide shaft having an axis parallel to the drive shaft. The belt typically has pins projecting from it to engage perforations provided in the record medium to drive the record medium along a linear path. Feed tractors are normally employed in pairs at opposite edges of the record medium to drive the record medium from both its opposite edges.

Because the record medium may come in varying widths, the tractors must be laterally movable along the drive and guide shafts. When two tractors are positioned such that the driving pins of each tractor are properly aligned with the perforations along each edge of the record medium, each tractor must be clamped securely to the guide shaft. Clamping devices used to secure a tractor to the guide should be able to clamp and release quickly so as to enable easy and accurate positioning and repositioning of the tractors.

Many attempts have been made to provide suitable clamping devices for tractors. Clamping blocks attached to tractors and secured to the support shafts by clamping bolts have been proposed (see Nystrand Pat. No. 3,608,801, issued Sept. 28, 1974). Quick release devices having cam surfaces have also been proposed (Davies U.S. Pat. No. 3,283,875, issued Nov. 8, 1966). Such devices have several drawbacks. Each device consists of two or more components such as levers, screws, nuts, camming surfaces, springs and so on. The number of parts on the required assembly obviously increases the cost of manufacturing and assembling such clamping devices. Additionally, these types of clamping devices may apply forces to the drive and guide shafts, which skew the tractors and cause interference with the tractor drive. The guide shaft need only be bent slightly in order to cause binding in the drive shafts. Misalignment of the driving pins carried by the tractor belt may also result from bending of the tractor shafts causing jamming or tearing of the record medium.

DISCLOSURE OF THE INVENTION

In accordance with the present invention, we provide a one piece clamping device having two substantially parallel arms joined by a member having size and shape to engage a guide shaft to secure the tractor to the shaft. Movement of the two arms towards each other releases the clamping device from the guide shaft to permit lateral movement of the tractor along the shaft.

THE DRAWING

DETAILED DESCRIPTION

Figure 1:
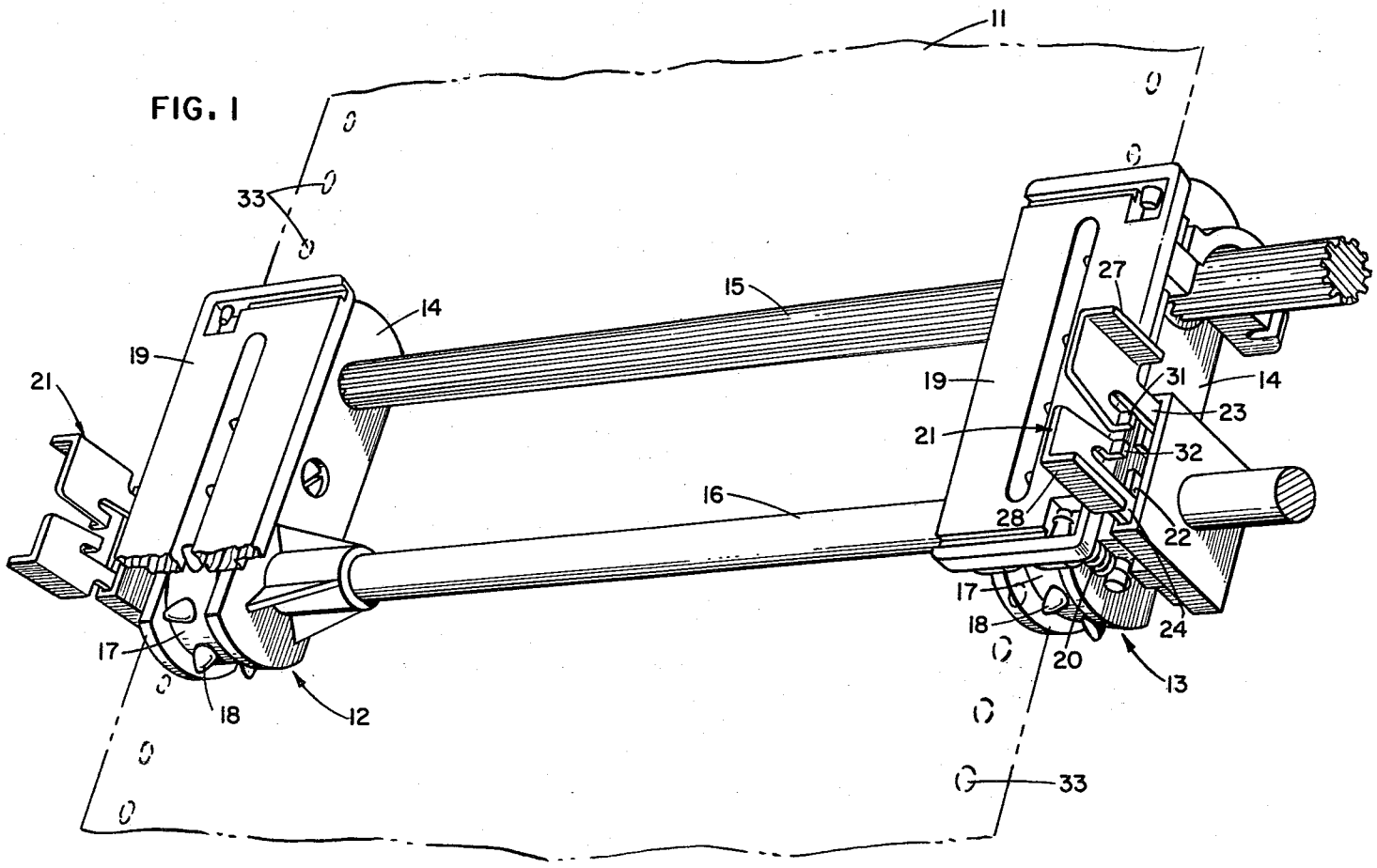
FIG. 1 shows a perspective view of a pair of tractors as employed in a printer showing the manner in which a tractor may be adjustably positioned and clamped in place.
Figure 2:
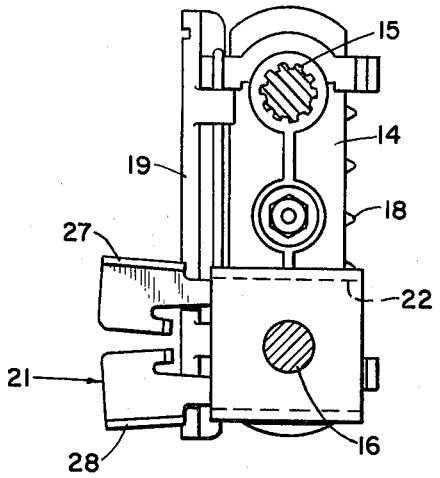
FIG. 2 is a side view of one of the tractors shown in FIG. 1.

Referring to FIG. 1, there is shown a typical installation for feeding a record medium 11 which is typical of the perforated edge forms used in printers associated with computers, teleprinters or other similar devices.

The record medium 11 is fed through a printer (not shown) by a pair of tractors 12 and 13. These tractors have frames 14 which are mounted on a pair of parallel shafts 15 and 16. The shaft 15 is a drive shaft and is driven by the motor of the printer (not shown) with which the tractors 12 and 13 are used. The shaft 16 is a guide shaft which supports and guides the tractors 12 and 13 relative to the drive shaft 15. The drive shaft 15 engages a sprocket wheel (not shown) which drives an endless belt 17 having a plurality of drive pins 18. The drive pins 18 engage perforations 33 in the record medium 11 and thus linearly advance the record medium 11 through the printer.

Each of the tractors 12 and 13 is secured to the guide shaft 16 by a clamping device 21 (tractor position clamp) which is held in an aperture 22 located in each of the tractor frames 14.

Figure 5:
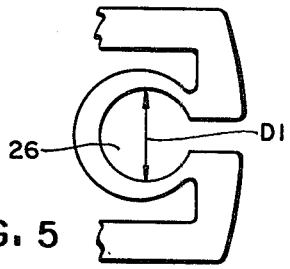
FIG. 5 is a partial view of the clamping device shown in FIGS. 3 and 4.
Figure 3:
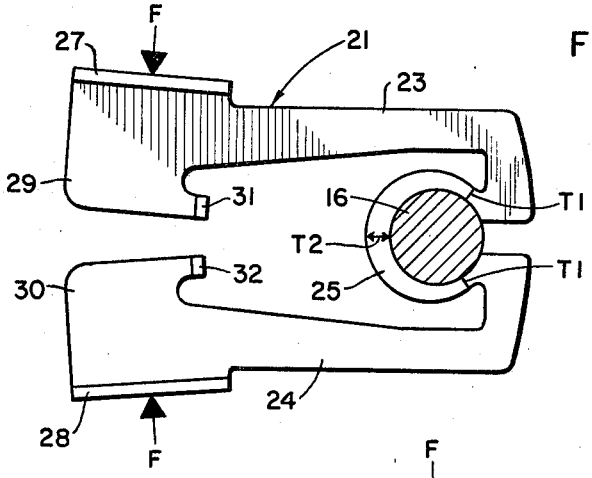
FIG. 3 is a front view of the clamping device shown in FIGS. 1 and 2, removed from the tractor and shown in the clamping device engaging the guide shaft.
Figure 4:
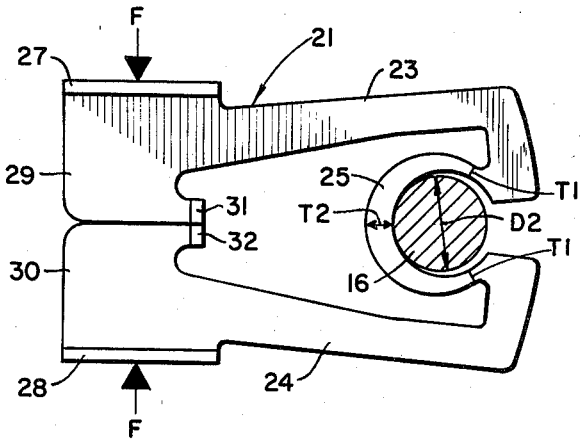
FIG. 4 is a view similar to the one shown in FIG. 3, with the clamping device disengaged from the guide shaft enabling the guide shaft to move freely through the opening in the clamping device.

Referring now to FIGS. 3, 4 and 5, the clamping device 21 has arms 23 and 24 which are parallel to each other and are a mirror image of each other. The arms 23 and 24 are joined by a substantially circular member 25 which partially encloses the substantially circular opening 26. The diameter of the opening 26 is sufficiently smaller than the diameter of the guide shaft 16 so as to ensure a positive interference fit between the member 25 and the guide shaft 16. The diameter $D_1$ of the opening 26 is related to the diameter $D_2$ of the guide shaft 16 by the following relation: $D_1/D_2=0.984$.

Arms 23 and 24 have tabs 27 and 28 which extend substantially perpendicularly from the arms 23 and 24, respectively. The tabs 27 and 28 allow an operator of the equipment employing the tractors to grasp the tabs 27 and 28 and to apply a force F to move arms 23 and 24 toward each other. The movement of the two arms 23 and 24 toward each other enlarges the opening 26, disengaging the clamping device 21 from the guide shaft 16 and permits lateral movement of the tractors 12 or 13 along the guide shaft 16 and drive shaft 15. To ensure proper enlargement of the opening 26, the width $T_2$ of the mid-section of the circular member 25 joining the two arms 23 and 24 is related to width $T_1$ of each of the sections of member 25 connecting to arms 23 and 24 by the following expression: $T_1/T_2=0.625$.

Arms 23 and 24 have end portions 29 and 30, respectively, which are made sufficiently wide to limit the travel of the arms 23 and 24 so as not to exceed the elastic limit of the material from which the circular member 25 is formed. As an additional precaution to limit the travel of the arms 23 and 24, each end portion 29 and 30 has projections 31 and 32, respectively, which would further restrict the movement of the arms 23 and 24, should the arms 23 and 24 be skewed during application of force F.

The clamping device 21 is stamped from a flat sheet of cold rolled annealed steel approximately 3/64" thick, and tabs 27, 28, 31 and 32 are formed by secondary operations either in the same progressive die or by some other well known secondary manufacturing means.

The clamping device 21 is positioned in the aperture 22, which has a substantially rectangular shape, so that the free ends of arms 23 and 24 along with tabs 27 and 28 and projections 31 and 32 extend outside of the aperture 22. The width of the aperture 22 is made sufficiently smaller than the thickness of the clamping device 21 ensuring an interference fit between the clamping device 21 and tractor frame 14.

What is claimed is:

1. A printer tractor having a frame and an endless belt for advancing a record medium through a printing machine, said printer tractor mounted on a guide shaft extending through said frame, and said printer tractor being laterally movable along said guide shaft for adjustment of position to accommodate different widths of said record medium, the printer tractor including a clamping device comprising:

a one piece metal stamping including two parallel arms each having a free end extending in a first direction and each arm being a mirror image of the other, and a member joining said two arms, said joining member having a substantially circular shape and located between and apart from said arms, said joining member and said parallel arms defining a keyhole shaped opening facing in the opposite direction from said first direction, said keyhole shaped opening includes a substantially circular portion having a diameter sufficiently smaller than the diameter of said guide shaft so as to insure a positive interference fit between said clamping device and said guide shaft and a small rectangular portion located below and interconnected with said circular portion and wherein movement of said parallel arms towards each other applies a separating force at the rectangular portion of the opening enlarging said circular portion thereby disengaging said clamping device from said guide shaft.

2. A printer tractor position clamp in accordance with claim 1, wherein the width $T_1$ of each end of said member joining said two parallel arms is related to the width $T_2$ of the middle section of said member by the expression $T_1/T_2=0.625$.

* * * * *